US005135408A

United States Patent [19]

Suzuki

[11] Patent Number: 5,135,408

[45] Date of Patent: Aug. 4, 1992

[54] CONNECTOR ASSEMBLY

[75] Inventor: Tetsuaki Suzuki, Shizuoka, Japan

[73] Assignee: Yazaki Corporation, Japan

[21] Appl. No.: 785,003

[22] Filed: Oct. 30, 1991

[30] Foreign Application Priority Data

Oct. 31, 1990 [JP] Japan ..... 2-114303[U]

[51] Int. Cl.[5] ..... H01R 13/62

[52] U.S. Cl. ..... 439/310; 439/372

[58] Field of Search ..... 439/310, 311, 350–358, 439/372, 152–160, 347, 296

[56] References Cited

U.S. PATENT DOCUMENTS

| | | | |
|---|---|---|---|
| 1,442,837 | 7/1976 | Socapex . | |
| 2,998,588 | 8/1961 | Chamberlain . | |
| 3,392,245 | 7/1968 | Asick . | |
| 3,596,230 | 7/1971 | Ecker . | |
| 3,750,087 | 7/1973 | Vetter . | |
| 3,947,081 | 3/1976 | Peterson . | |
| 4,241,966 | 12/1980 | Gomez | 439/372 |
| 4,332,432 | 6/1982 | Colleran . | |
| 4,586,771 | 5/1986 | Kraemer et al. . | |
| 4,878,853 | 11/1989 | Yamade et al. | 439/372 |
| 4,995,821 | 2/1991 | Casey | 439/372 |
| 5,021,003 | 6/1991 | Ohtaka et al. | 439/372 |

FOREIGN PATENT DOCUMENTS

| | | | |
|---|---|---|---|
| 52-133993 | 12/1977 | Japan . | |
| 2-278674 | 11/1990 | Japan | 310/ |

*Primary Examiner*—David L. Pirlot

*Attorney, Agent, or Firm*—Wigman & Cohen

[57] ABSTRACT

Disclosed is a connector assembly, which includes a first housing having a first surface which is level and parallel to a longitudinal direction; a second housing adapted to be received within the first housing and movable longitudinally relative to the first housing between an initial position and an inserted position; at least one pair of terminals aligned in parallel to the longitudinal direction and being mounted in the first and the second housings; a shift member provided on the first housing so as to be shiftable between a first position and a second position in parallel to the first surface of the first housing; and interengaging mechanism adapted to be associated between the second housing and the shift member. The terminals are engaged with each other when being axially moved toward each other in accordance with movement of the housings into the inserted position. The shift member is locked in the first position by locking mechanism. When the second housing lies in the initial position, the lock is released by releasing mechanism by means of the insertion action of the second housing in order to shift the shift member into the second position. When the shift member lies in the second position, the second housing is allowed to move longitudinally in the first housing, then the shift member is allowed to shift from the second position to the first position while associating the interengaging mechanism. The interengaging mechanism including a slot and a follower member being received by the slot movably within the slot.

20 Claims, 5 Drawing Sheets

CONNECTOR ASSEMBLY

BACKGROUND OF THE INVENTION

1. Field of the Invention

The present invention relates to a connector assembly of the type in which a pair of terminals is mounted in a first housing and a second housing, and where the second housing can be received movably within the first housing so as to mate the terminals.

2. Description of the Prior Art

One prior art electrical connector assembly which is disclosed by Nishino et al. in Japanese Laid Open Utility Model Application (Kohkai) No. 52-133993 is shown in FIGS. 1 and 2. The electrical connector 1 shown in these drawings comprises a female connector 3 called a receptacle which is fixed to a panel 7 and a male connector 5 called a plug. The female connector 3 has a hood 9 into which the male connector 5 is to be inserted for electrical connection, an insulator housing 11 integrally formed on the hood 9, and a pair of projections 13 protruding from the both lateral sides of the hood 9. The housing 11 has a plurality of terminal accomodating chambers in each of which a male electrical terminal called a core pin (not shown) is contained. Tip portions of the male terminals protrude into the hood 9. On the other hand, the male connector 5 has a plurality of terminal accomodating chambers in each of which a female electrical terminal is contained. The female terminals are to be engaged with the male terminals through the insertion of the male connector 5 into the female connector, thereby completing an electrical connection. Moreover, each of the female terminals has a cable which extends from a rear side of the male connector 5 and is supported by a cable clamp 21.

On both lateral sides of the male connector 5, a pair of levers 15 are pivotably supported with rivets 17. The levers 15 extend along the lateral side of the male connector 5, and the ends of the levers are connected to one other through a handle 23 outside the male connector 5. Each of the levers 15 has a guide groove 25 provided on the opposite end from the handle 23. The guide groove 25 is formed such that the groove 25 can receive the projection 13 at the opening portion 25*a* and guide it toward the interior closed end thereof and ensure that the distance between the rivet 17 and the groove 25 is shorter at the closed end than that at the opening portion 25*a*. Moreover, two pairs of keys 27, 28 are provided for preventing incorrect engagement of the male and female connectors 5, 3 on the upper and lower sides of the male and female connectors 5, 3.

For connecting the male connector 5 with the female connector 3, the male connector 5 is inserted into the female connector 3 along a direction indicated by an arrow A shown in FIG. 1, and the projections 13 are received by the grooves 25 of the levers 15 at the opening portion 25*a*. Then, the levers 15 which are supported by stoppers 29 are turned around the rivet 17 in a direction shown by an arrow B in FIG. 1. At this time, the projection is guided into the groove 25 causing further insertion of the male connector 5 into the female connector 3. On the other hand, the handle 23 between the levers 15 abuts a spring stopper 31 to press the stopper 31 downwards. After passing over the stopper 31, the handle 23 is locked by the stopper which is resiliently pushed out by elastic force, whereby the levers 15 are secured and retain the projections 13 in the grooves 25. On the contrary, when detaching the male connector 5 from the female connector 3, the levers 15 are turned in the reverse direction to return the handle 23 back against the stopper 31.

However, in the above prior art connector assembly, because suitable longitudinally elongated levers are required for the purpose of operational ease, possible compactness of the connector assembly is limited. Moreover, since the levers are simply supported by the stoppers when the connector assembly is detached, the levers moves freely, whereby difficulty may be encountered when trying to align the projections with the groove openings on the levers in order to insert the projections into the grooves. Similarly, in the freely movable levers which extend out of the lateral sides of the housings, the rivet connection may be easily damaged by a shock received during the treating and transporting of the connectors.

SUMMARY OF THE INVENTION

Therefore it is an object of the present invention to provide a connector assembly having a shift lever member which can be locked to the connector housing when the male and female connectors are detached, and can be easily connected to one another.

Another object of the present invention is to provide a connector assembly having a troubleproof shift lever member making it possible to increase the compactness of the connector assembly.

In order to achieve the above-mentioned objects, a connector assembly according to the present invention comprises: a first housing having at least one first surface being substantially level and parallel to a longitudinal direction; a second housing adapted to be received within the first housing and movable in the longitudinal direction relative to the first housing between an initial position and an inserted position; at least a pair of terminals having aligned longitudinal axes parallel to the longitudinal direction, one terminal being mounted in the first housing and the pair of terminal being mounted in the second housing so that the terminals are engaged with each other when the pair of terminals are axially moved toward each other in accordance with movement of the housings into the inserted position; a shift member provided on the first housing so as to be shiftable between a first position and a second position in a plane parallel to the first surface of the first housing; interengaging means adapted to be associated between the second housing and the shift member in such a manner that, when the shift member lies in the second position, the second housing is allowed to move in the longitudinal direction to associate the interengaging means, and that the shift member is allowed to shift between the first position and the second position while associating the interengaging means; means for locking the shift member in the first position; and means for releasing the shift member from the first position by means of the insertion action of the second housing when the second housing lies in the initial position.

The interengaging means including a slot means and a follower member being received by the slot means so as to be movable within the slot means.

Further, the assembly according to the present invention may comprise means for holding the second housing in the inserted position.

BRIEF DESCRIPTION OF THE DRAWINGS

The features and advantages of the connector assembly according to the present invention over the proposed assembly will be more clearly understood from the following description of the preferred embodiments of the present invention taken in conjunction with the accompanying drawings in which like reference numerals designate the same or similar elements or sections throughout the figures thereof and in which.

DETAILED DESCRIPTION OF THE PREFERRED EMBODIMENTS

Figure 1:
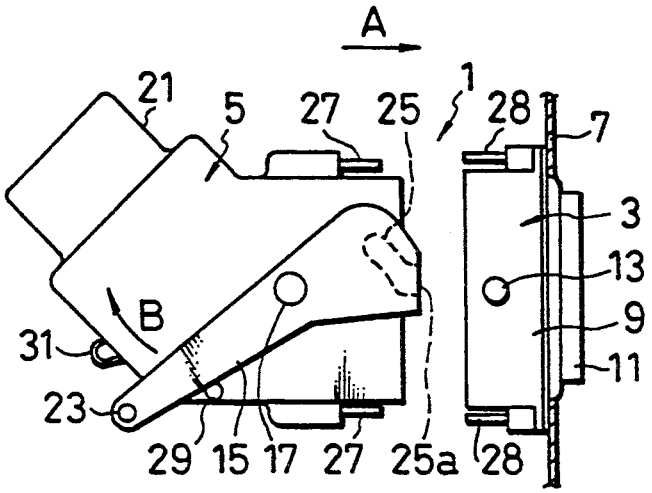
FIG. 1 PRIOR ART
FIG. 1 is a lateral side view showing the prior-art connector assembly before engaging.
Figure 2:
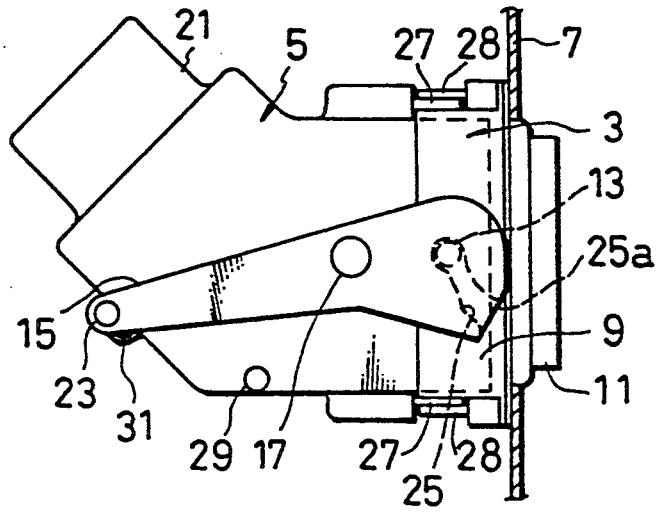
FIG. 2 PRIOR ART
FIG. 2 is a lateral side view showing the prior-art connector assembly after engaging.

Referring now to the drawings, preferred embodiments of the connector assembly according to the present invention will be described.

Figure 3:
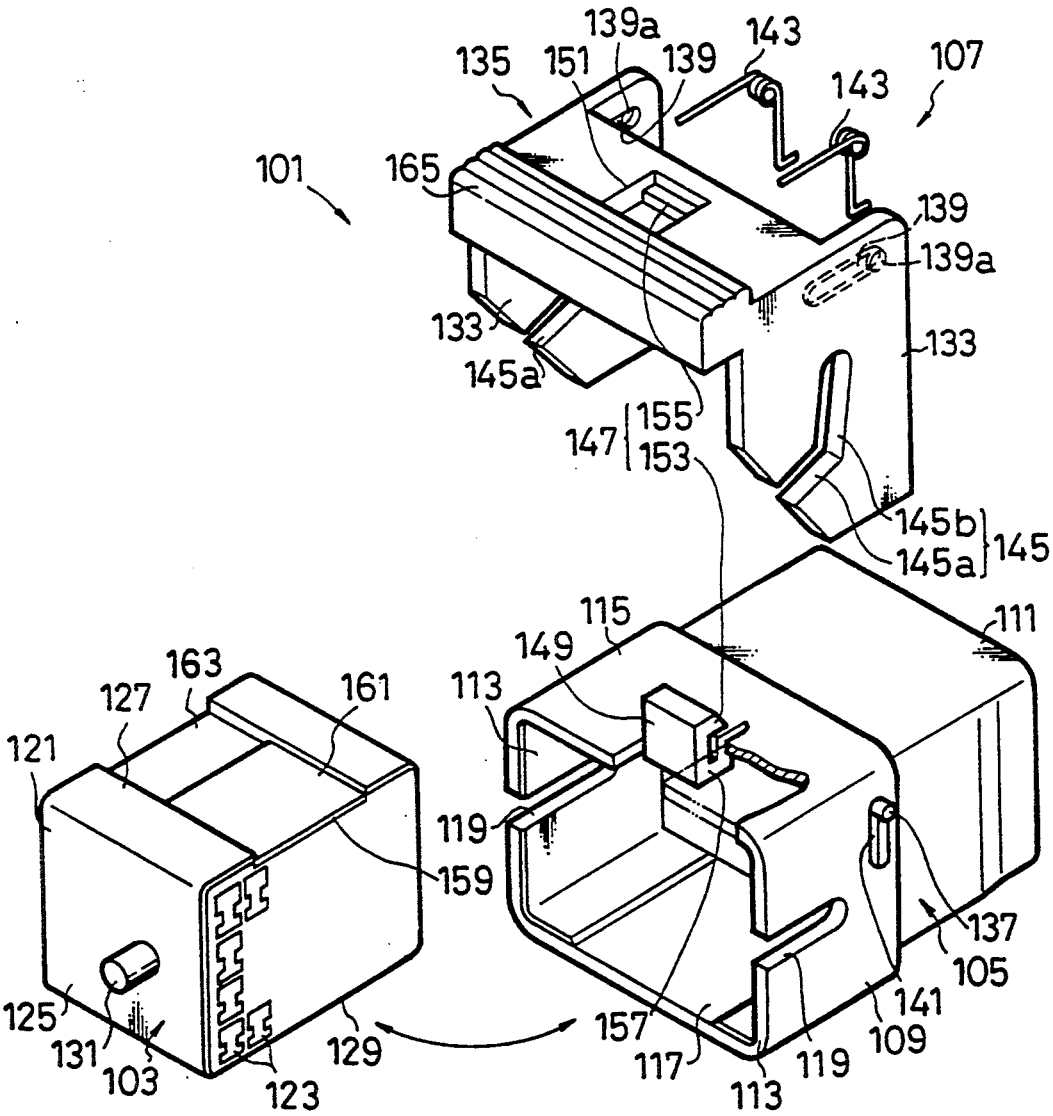
FIG. 3 is a magnified view of the first embodiment of the connector assembly according to the present invention.

FIG. 3 shows a first embodiment of the connector assembly according to the present invention. As shown in the drawing, the connector assembly 101 is a rectangular box-type assembly comprising a male connector 103, a female connector 105 and a covering part 107 rotatably assembled on the female connector 105. The female connector 105 has a first housing including a hood 109 with front and rear open ends and a body casing 111 which is fixedly connected to the rear open end of the hood 109 and contains a plurality of male type electrical terminals (not shown). The male terminals have longitudinal axes aligned in parallel, and their tip portions protrude into the hood 109. The hood 109 has a pair of side walls 113 parallel to each other, and top and bottom walls 115, 117 which are also parallel to each other and perpendicular to the side walls 113. Each of the side walls 113 has a slit 119 parallel to the top and bottom walls 115, 117, respectively.

The male connector 103 has a second housing, that is, a body casing 121 with a mating face, enclosing a plurality of terminal accomodating chambers 123. Each of the terminal accomodating chambers contains a female type electrical terminal (not shown). The male connector 103 has two level outer side surfaces 125 parallel to each other and top and bottom surfaces 127, 129. The male connector 103 is adapted to be inserted by sliding it in the axial direction of the longitudinal terminals, and to fit in the hood 109 of the female connector 105. The terminal accomodating chambers 123 are arranged so that, when the male connector 103 is inserted in the female connector 105, the female terminals are engaged with the male terminals to complete electrical connections. At this time, the position of the female connector 105, placed so as to complete the electrical connections in the hood 109, is defined as an inserted position.

A pair of projections 131 are formed on each of the outer side surfaces 125 in such a manner that, when the male connector 103 is inserted into the hood 109 of the female connector 105, each of the projections 131 is received by the corresponding slit 119 to protrude slightly outside the hood 109. In response to the inserting action of the male connector 103, each of the projections 131 becomes movable within the slit 115.

The covering part 107 of the connector assembly according to the present invention includes a pair of shift members 133 and a pivotable member, namely a lever plate 135 formed integrally with the shift members 133. On the side walls 113 of the hood 107, a pair of pivotal projections 137 are formed at the rear top portions of the outer flat surfaces thereof. On the other hand, a pair of grooves 139 are formed on the inner surfaces of the shift members 133 at the rear top portions thereof so as to extend laterally. Each of the pivotal projections 137 is adapted to be received by a rear end portion **139*a* of each of the grooves 139, respectively, so that the shift member 133 and the lever 135 are able to cover the side walls 107 and top wall 115 of the hood 109 fittingly. According to the above construction, the covering part 107 can rotate with respect to the pivotal projections 137. Here, the position of the shift member 133, when the covering part 107 fittingly covers the hood 109**, is defined as a first position of the shift member.

On the outer surfaces of the side walls 113 of the hood 109, a pair of grooves 141 are formed so as to extend from each of the pivotal projections 137 vertically downwards. A pair of coiled springs 143 having two extending ends is received at the pivotal projections 137 between the side walls 113 of the hood 109 and the shift members 133 of the covering part 107. The ends of the springs 143 are received in the grooves 139 on the shift member 133 and grooves 141 on the side wall 113, respectively, and the coiled springs forces the lever 135 to leave the first position and move in an upward direction against the hood 109 so as to separate the lever 135 from the top wall 115 of the hood 109.

Each of the shift member 133 is formed as a flat plate in which the front lower portion is cut away at an incline so that the peripheral edge of the section runs vertically, namely, in parallel to the periphery of the hood 109 when the shift member is rotated at a predetermined angle upwards along a clockwise direction when facing the apparatus as in FIG. 3. The shift member 133 has a L-shaped slot 145 extending from the sectional edge and comprising a guide slot **145*a* and a cam slot 145*b* in series. The guide slot 145*a* is formed at an incline so that, when the shift member 133 rotates at the predetermined angle in the clockwise direction with respect to the pivotal projection 137, the guide slot 145*a* runs horizontally fitting into the slit 119 of the hood 109, whereby the projections 131 become movable along the guide slots 145. Here, the position of the shift member 133 where the guide slot 145*a* coincides with the slit 119 is defined as a second position of the shift member. On the other hand, when the shift member 133 lies in the first position, the cam slot 145*b* extends from the guide slot 145*a*, turning toward the topside of the covering part 107 so as to extend to the same height of the slit 119**.

In the connector assembly of the present invention, anchoring means 147 is provided between the top wall 115 of the hood 109 and the lever 135 for anchoring the covering part 107 to the hood 109 thereby locking the shift members 133 in the first position. Specifically, a lock arm 149 is integrally provided on the hood 109. The lock arm 149 extends from a rear side edge of a square notch on the top wall toward the inside of the hood 109 and is bent upwards at the base portion so as to pass through a rectangular aperture 151 formed on the lever 135, while slightly protruding downward near the base portion inside the hood 109. The lock arm 149 has a hook-shaped nail 153 formed at a tip portion thereof so as to engage with a small step 155 which is formed at the rear side of the aperture 151. By engaging the nail 153 with the step 155 being biased upwards by the coiled springs 143, the covering part 107 is secured to the hood 109. According to the above construction, the lever 135 and the anchoring means comprise means for locking the shift member 133 in the first position.

The connector assembly according to the present invention further comprises means for releasing the shift member from the first position and urging the shift member into the second position through the insertion action of the male connector 103. More specifically, the releasing means includes an inward protrusion 157 of the lock arm 149. When the male connector 103 is inserted in the hood 109 of the female connector 105, the inward protrusion 157 abuts against a peripheral edge 159 of the male connector 103, though the front top surface 161 of the body casing 121 is slightly depressed in the vicinity of the abutting peripheral edge 159. The lock arm 149 is elastically distorted against the peripheral edge 159 near the base portion of the lock arm. Here, the position of the male connector 103 when the peripheral edge of the male connector abuts the inward protrusion 157 of the lock arm 149 is defined as an initial position.

Moreover, the top surface of the male connector 103 has a receiving portion for the inward protrusion 157, namely, the rear top surface 163 which is located below the front top surface and is depressed enough to receive the protrusion 157 after the insertion. The step defined between the front top surface 161 and the rear top surface 163 holds the male connector 103 in the hood 109 by catching the inward protrusion 157.

FIGS. 4A to 4D are sectional views explaining the engaging operation, taken along the longitudinal direction of the second embodiment of the connector assembly according to the present invention. Here, the longitudinal direction is shown by an arrow L in FIG. 4A. Although the second embodiment illustrated in FIGS. 4A to 4D and the first embodiment shown in FIG. 3 differ in terms of the shape of the protrusion 157 of the lock arm 149 and the cam slot **145*b* of the shift member 133, the first and second embodiments operate essentially in the same manner. Therefore, engaging operation of the connector assembly according to the present invention will be explained with reference to FIGS. 4A to 4D** as follows.

Figure 4A:
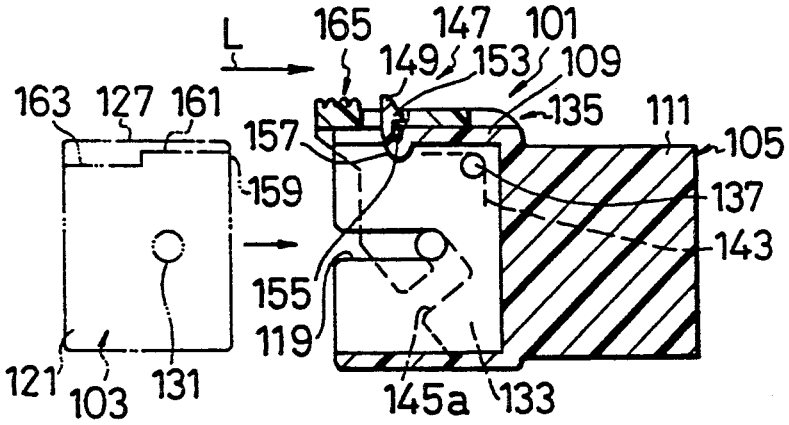
FIGS. 4A to 4D are vertical sectional views for explanation of the engaging operation, taken along the longitudinal direction of the second embodiment of the connector assembly according to the present invention.
Figure 4B:
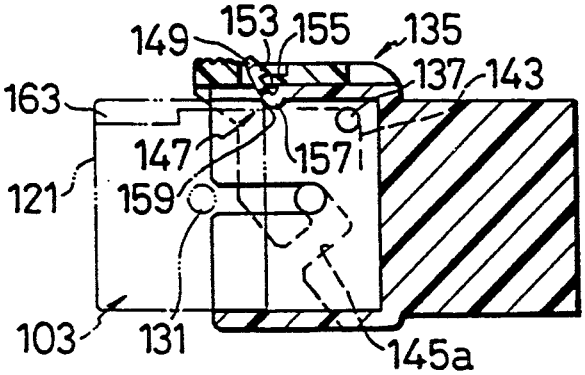

FIG. 4A shows the connector assembly 101 before actual engaging. In this state, the nail 153 is engaged with the step 155 against the lever 135 being biased upwards by the coiled springs 143. By this engagement, the lever 135 is anchored, and the shift member 133 is locked in the first position, accordingly. First, the male connector 103 is inserted in the hood 109 to approach the initial position of the male connector 103 as shown in FIG. 4B. Once in the initial position, the peripheral edge 159 of the male connector 103 abuts the round bottom portion of the lock arm 149, that is, the inward protrusion 157, and the peripheral edge thrusts the inward protrusion 157, thereby forcing it into the inner side of the hood 109, where it moves the lock arm elastically to an inclined position supported by the base portion. This elastic movement causes a slight inclination of the lock arm 149 at the tip portion in a direction opposite to that of the insertion direction. As a result, the nail 153 separates from the small step 155 of the lever 135. At this time, since the lever 135 is biased upwards by the coiled springs 143, the lever 135 rotates along with the pair of pivotal projections 137 in a clockwise direction when facing the assembly as in FIG. 4B with respect to the pivotal axis, while the nail 153 escapes from the lever 135 by passing through the aperture 151. As a result, the pivotal member 135 leaves the lock arm 149 and the top wall 115 as shown in FIG. 4C.

Figure 4C:
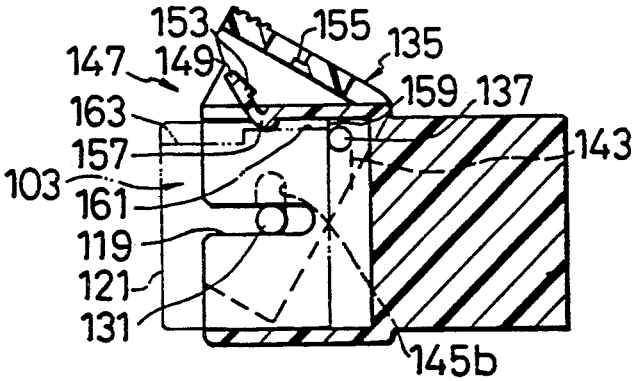
Figure 4D:
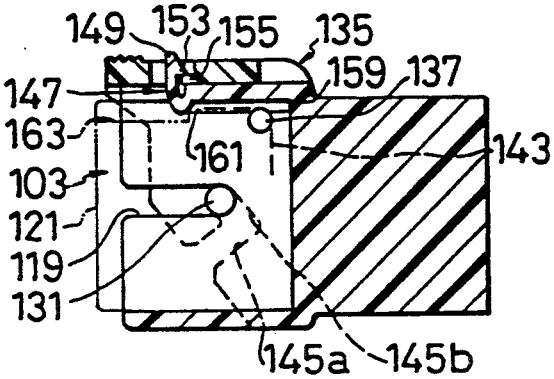

Accompanying the above operation of the lever 135, each of the shift members 133 also rotates together with the lever 135 with respect to the pivotal projections 137 to shift from the first position to the second position as shown in FIG. 4C. In their way, each of the guide slots **145*a* of the shift members 133 coincides with the corresponding slit 119 on the hood 109. At this time, if the male connector 103 is pushed into the hood 109 against the inward protrusion 157, the projections 131 are guided through the guide slots 145*a* and the slits 119 until the projections 131 reach the corners between the guide slots 145*a* and the cam slots 145*b*. Here, the position of the male connector 103 when the projections reach those corners is defined as an intermediate position. After this operation, by pressing the lever 135 downwards to the top wall 115 with a press member 165 formed on the tip portion of the lever 135, the cam slots 145*b* rotate downwards in the counterclockwise direction in FIG. 4C around the pivotal projections to receive the projections 131. The cam slots 145*b*, rotating downwards, force the projections 131 to travel further toward the closed ends of the slits 119 as shown in FIG. 4D. Also, according to this operation, the male connector 103 is further pulled in the hood 109. As a result, the male connector 103 reaches the inserted position where the terminals are electrically connected, and at the same time, the shift member 133 turns back to the first position while allowing the lock arm to pass through the aperture 151. In this state, the slits 119 of the hood 109 meet with the slots 145 of the shift members 133 only at the closed ends thereof, where the projections 131 are received. Here, it is to be noted that the lack of a front lower portion in the shift member 133 allows for the avoidance of the projection 131 during the rotation of the shift member 133**.

On the other hand, when the male connector 103 reaches the inserted position, the downward protrusion 157 is received by the receiving portion 163, and the nail 153 is engaged again with the step 155 against the lever 135 which is biased upwards by the coiled springs 143. By this engagement, the lever 135 is anchored, and the shift member 133 is locked in the first position, accordingly. At the same time, the male connector 103 is held in the inserted position, being caught by the inward protrusion 157 at the step defined between the front top surface 161 and the receiving portion 163.

In FIGS. 4A to 4D, if the cam slot 145*b* is provided so as to form an arc centered around the pivotal projection, there is caused no further insertion of the male connector 103 from the intermediate position to the inserted position according to the rotation of the shift member 133 as shown in FIGS. 4C and 4D. Namely, the additional insertion can be set and regulated by changing the deviation of the slot 145*b* from the arc at the closed end.

Moreover, various changes can be brought about in the present invention. FIGS. 5 to 8 show three illustrated examples of the modification of the locking means.

Figure 5:
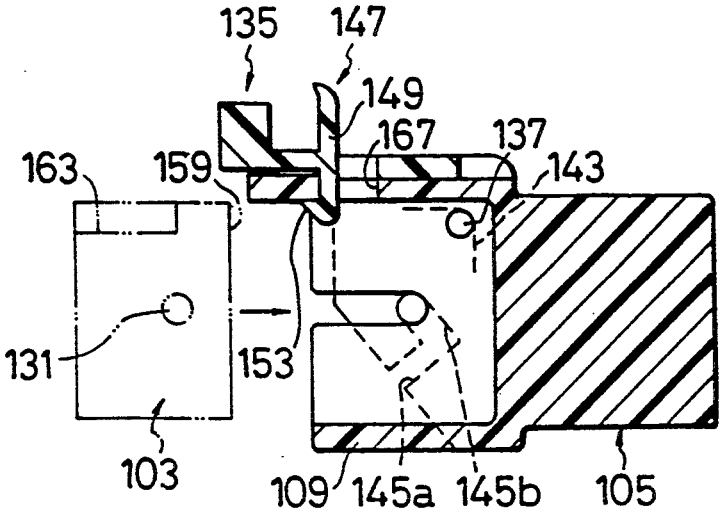
FIG. 5 is a vertical longitudinal sectional view of the third embodiment of the connector assembly according to the present invention.
Figure 6:
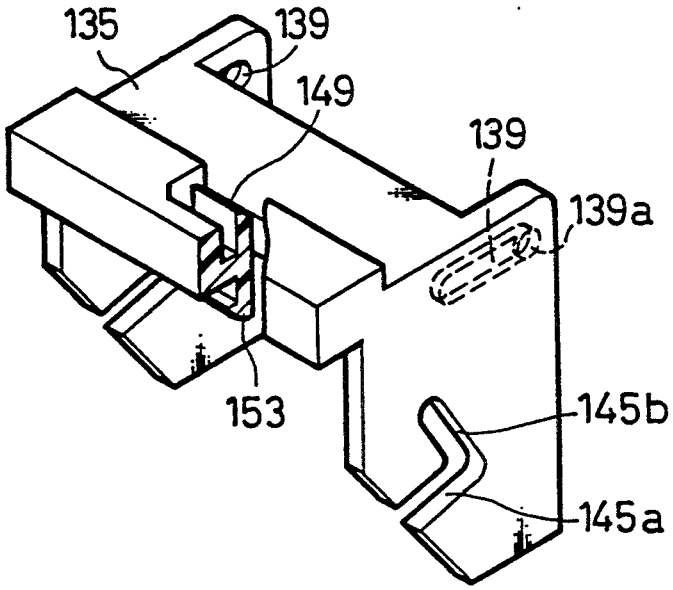
FIG. 6 is a perspective view of a covering part of the connector assembly shown in FIG. 5.

In the third embodiment of the present invention which is shown in FIGS. 5 and 6, the lock arm 149 is formed on the lever 135 and extends downwards to pass through an aperture 167 formed on the hood 109. The nail 153 being directed against the inserting direction, namely, directed in the forward direction as shown in FIG. 6 is formed on the lower tip portion of the lock arm so as to engage with the hood 109 at the inner surface of the periphery of an aperture 167. In this embodiment, the lower tip of the nail 153 corresponds to the inward protrusion 157 of the former embodiments. In operation, the male connector 103, which is in the initial position, abuts the tip of the nail 153 and elastically forces the nail 153 to the inclined position, whereby the nail 153 disengages from the periphery of the aperture 167 of the hood 109. Similar to the former embodiments, the lever 135 is urged by the coiled springs 143 to rotate in the clockwise direction in FIG. 5, and the shift members 133 are shifted to the second position. After the insertion of the male connector 103 to the intermediate position, the lever 135 is pressed toward the hood 109, being accompanied by the caming action of the guide slots 145*b* and the projections 131. The nail 153 is forced elastically against the periphery of the aperture 167 to the inside of the hood 109, and it is received by the receiving portion 163 and engage with the hood 109.

In the above embodiment, the other end of the lock arm 149 extends upward. According to this construction, the operator can manually disengage the nail 153 from the hood 109 by nipping the upper end of the lock arm 149 and the peripheral portion of the shift member 135 so as to shift the lock arm 149 to an inclined position.

Figure 7:
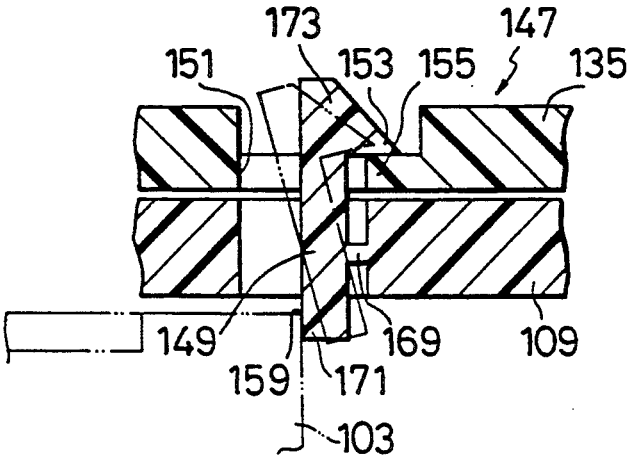
FIG. 7 is a cross-sectional view showing locking means in the fourth embodiment of the connector assembly according to the present invention.

FIG. 7 shows a forth embodiment according to the present invention. In this embodiment, the lock arm 149 is formed on the hood 109 so as to engage at the nail 153 with the small step 155 which is formed at the rear side of the aperture 151 on the lever 135. As shown in the drawing, the elongated lock arm 149 extends vertically, and it is formed integrally with the hood 109 in a shape such that a small base portion 169 connects the intermediate portion of the elongated lock arm 149 to the hood 109. The lower end 171 of the lock arm 149 extends to the inside of the hood 109, and the upper end portion 173 is provided with the nail 153.

In operation, when the edge of the male connector 103 abuts and pushes the lower end 171 of the lock arm 149, the lock arm 149 is elastically bent at the base portion 169 to an inclined position which is then supported by the base portion 169. According to this operation, the nail 153, which is located at the upper end opposite to the depressed end, moves in the opposite direction to the movement of the depressed lower end. Then, the connector assembly of this embodiment operates in the same manner as in the above-described embodiments.

Figure 8:
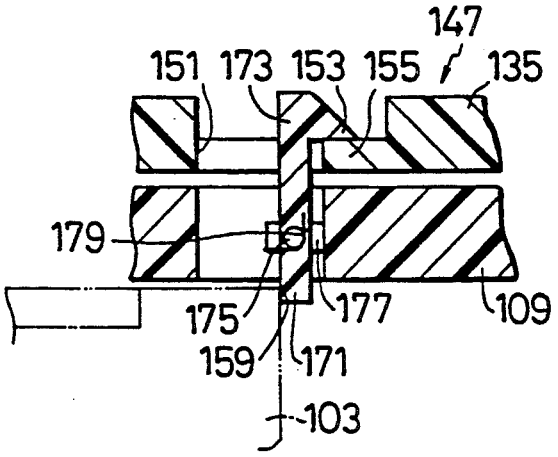
FIG. 8 is a cross-sectional view showing locking means in the fifth embodiment of the connector assembly according to the present invention.

FIG. 8 shows a fifth embodiment according to the present invention. Also in this embodiment, the lock arm 149 is arranged on the hood 109 so as to operate in the same manner as in the forth embodiment. However, in this embodiment, the elongated lock arm 149 extending vertically is formed separately from the hood 109. The lock arm 149 is rotatably supported by a pivotal shaft 175 on a support arm 177 which extends laterally from the hood 109. The lock arm 149 is elastically biassed by means of a coiled spring 179 to stand vertically in order to engage at the nail 153 with the small step 155 on the lever 135. With the exception of the above features, the connector assembly of this embodiment is constructed similarly to the forth embodiment. Here, it should be noted that the lock arm 149 being elastically biassed by the coiled spring 179 acts essentially in the same manner as one that is integrally formed with elasticity in the forth embodiment. Therefore, the connector assembly of this embodiment operates in the same manner as that of the forth embodiment.

As mentioned above, in the connector assembly according to the present invention, the covering part, before engaging the male and female connectors, is anchored to the hood of the female connector, and if the male connector is inserted in the hood of the female connector to the initial position, the nail is automatically disengaged by the inserting force in accordance with the construction of the locking means and the releasing means. Moreover, the male connector can be completely inserted into the hood of the female connector, when forced by the additional insertion movement which is caused from caming action by the slots and follower projections. After insertion, the covering part is once again secured to and encloses the hood. The above-mentioned construction can easily prevent the shift members and the like from being damaged by shock according to the compact shape thereof.

In the present invention, it is of course possible to employ openings on the hood within the allowed limits of the longitudinal movement of the projections on the second housing other than the horizontal slits such as V-shaped notches and the like.

Moreover, it is also possible to arrange the shift members 133 inside the hood 109, by provision of slits in the top wall 115 of the hood. In this case, the pivotal projections 137 and grooves 139, 141 for receiving the coiled springs 143, are formed inside the side walls 113 of the hood.

In addition, it is also possible to construct the lock arm 149 of the first and second embodiments of the present invention so that the lock arm can be manually released from the engagement, by elongating the upper portion of the lock arm upwards. Alternatively, if the rear ends 138*a* of the grooves for receiving the pivotal projections 137 have added spaces for allowing the lever 135 to move slightly along the longitudinal direction so that the step 155 can escape from the nail 153, the lock is released by pushing the lever 135 in the longitudinal direction.

Moreover, it is possible to construct the first and second housings to be a polygonal cylinder type such as hexagonal, octagonal and the like other than the rectangular box type.

Furthermore, it is possible to omit the springs 79 from the above-mentioned embodiments of the connector assembly. In this case, the covering part is manually rotated when the male connector is set in the initial position. In the fifth embodiment of the present invention, also the spring 179 for the lock arm 149 can be omitted. In this case, the lock arm is constructed to be frictionally supported on the base portion, and the lock arm is manually hooked to the step on the hood after shifting the shift member back to the first position.

As mentioned above, it must be understood that the invention is in no way limited to the above embodiments and that many changes may be brought about therein without departing from the scope of the invention as defined by the appended claims.

What is claimed is:

1. A connector assembly comprising:

a first housing having at least one first surface being substantially level and parallel to a longitudinal direction;

a second housing adapted to be received within the first housing and movable in the longitudinal direction relative to the first housing between an initial position and an inserted position;

at least a pair of terminals having aligned longitudinal axes parallel to the longitudinal direction, one terminal being mounted in the first housing and the pair of terminal being mounted in the second housing so that the terminals are engaged with each other when the pair of terminals are axially moved toward each other in accordance with movement of the housings into the inserted position;

a shift member provided on the first housing so as to be shiftable between a first position and a second position in a plane parallel to the first surface of the first housing;

interengaging means adapted to be associated between the second housing and the shift member in such a manner that, when the shift member lies in the second position, the second housing is allowed to move in the longitudinal direction to associate the interengaging means, and that the shift member is allowed to shift between the first position and the second position while associating the interengaging means;

means for locking the shift member in the first position; and means for releasing the shift member from the first position by means of the insertion action of the second housing when the second housing lies in the initial position.

2. The connector assembly of claim 1, wherein the second housing reaches the inserted position through an intermediate position, and the interengaging means is constructed so that the shift motion of the shift member is accompanied by a longitudinal movement of the second housing between the intermediate position and the inserted position.

3. The connector assembly of claim 1, wherein the at least one first surface comprises a pair of level surfaces which are arranged outside the first housing in parallel to one another.

4. The connector assembly of claim 1, wherein the first surface is formed on an outer side of the first housing, and the shift member is arranged outside the first housing.

5. The connector assembly of claim 4, wherein the interengaging means including a slot means being arranged on the shift member and a follower member provided on the second housing and being received by the slot means so as to be movable within the slot means, and the first housing has an opening for allowing the follower to be received by the slot means through the first housing so as to be movable within the slot means.

6. The connector assembly of claim 5, wherein the opening is a slit along the longitudinal direction.

7. The connector assembly of claim 1, wherein the locking means includes:

a pivotable member being linked with the shift member in such a manner that the pivotable member recedes from the first housing in accordance with pivotal movement of the shift member from the first position into the second position; and means for anchoring the pivotable member to the first housing so as to hold the shift member in the first position.

8. The connector assembly of claim 7, wherein the first housing has a second surface which is substantially level and parallel to the longitudinal direction and intersects the first surface, and the anchoring means anchors the pivotable member on the second surface.

9. The connector assembly of claim 8, wherein the pivotable member includes a lever plate formed integrally with the shift member so as to cover the second surface of the first housing when the shift member lies in the first position.

10. The connector assembly of claim 7, wherein the anchoring means includes:

a nail biased to hook the pivotable member to the first housing.

11. The connector assembly of claim 1, wherein the releasing means includes:

an abutment member protruding inside the first housing so as to abut the second housing when the second housing lies in the initial position, and being linked to the locking means so as to release the shift member from the locking means by being thrusted by the second housing; and a receiving portion provided on the second housing for receiving the abutment member so as to prevent the abutment member from being thrusted by the second housing when the second housing lies in the inserted position.

12. The connector assembly of claim 1, further comprising:

means for biasing the shift member into the second position when the shift member is released from the first position by the releasing means.

13. The connector assembly of claim 12, wherein the biasing means includes a coiled spring provided between the first housing and the pivotable member so as to move the pivotable member away from the first housing.

14. The connector assembly of claim 10, wherein the nail is arranged on the first housing at the second surface to hook the pivotable member.

15. The connector assembly of claim 14, wherein the pivotable member has an aperture for allowing the nail to pass through the pivotable member, and the nail in order to catch the pivotable member is pointed in a direction away from the initial position toward the inserted position of the second housing in the outside of the pivotable member.

16. The connector assembly of claim 10, wherein the nail is arranged on the pivotable member to hook the first housing at the second surface.

17. The connector assembly of claim 16, wherein the first housing has an aperture for allowing the nail to pass through the first housing at the second surface, and the nail in order to catch the pivotable member is pointed in a direction away from the inserted position to the initial position of the second housing in the inside of the first housing.

18. The connector assembly of claim 7, wherein the releasing means includes:

an abutment member being integrally formed with the anchoring means to protrude inside of the first housing so as to abut a periphery of the second housing when the second housing lies in the initial position, the abutment member being thrusted by the second housing to move the anchoring means so as to release the shift member from the first housing; and a depressed portion provided on the second housing for receiving the abutment member so as to prevent the abutment member from being thrusted by the second housing when the second housing lies in the inserted position.

19. The connector assembly of claim 18, further comprising:

means for holding the second housing in the inserted position.

20. The connector assembly of claim 19, wherein the holding means includes a step bordering the depressed portion for catching the abutment member in the depressed portion against the second housing.

* * * * *